US011790768B2

(12) United States Patent
Desbrugères et al.

(10) Patent No.: US 11,790,768 B2
(45) Date of Patent: Oct. 17, 2023

(54) METHOD FOR CONFIGURING THE COMMUNICATION BETWEEN AT LEAST ONE ACTUATOR AND A REMOTE CONTROL UNIT

(71) Applicant: SOMFY ACTIVITES SA, Cluses (FR)

(72) Inventors: Thibaut Desbrugères, Araches la Frasse (FR); Rémi Vicente, Thyez (FR); Emmanuel Pauchard, Amancys (FR); Stéphane Bigonneau, Saint Pierre en Faucigny (FR); Maxime Salsini, Janneyrias (FR)

(73) Assignee: SOMFY ACTIVITES SA, Cluses (FR)

( * ) Notice: Subject to any disclaimer, the term of this patent is extended or adjusted under 35 U.S.C. 154(b) by 0 days.

(21) Appl. No.: 17/627,658

(22) PCT Filed: Jul. 1, 2020

(86) PCT No.: PCT/FR2020/051154
§ 371 (c)(1),
(2) Date: Jan. 15, 2022

(87) PCT Pub. No.: WO2021/009429
PCT Pub. Date: Jan. 21, 2021

(65) Prior Publication Data

US 2022/0277645 A1 Sep. 1, 2022

(30) Foreign Application Priority Data

Jul. 15, 2019 (FR) ..... 19/07983

(51) Int. Cl.
*G08C 17/02* (2006.01)
*A47H 5/00* (2006.01)

(52) U.S. Cl.
CPC ..... *G08C 17/02* (2013.01); *A47H 5/00* (2013.01); *G08C 2201/20* (2013.01);
(Continued)

(58) Field of Classification Search
CPC ..... G08C 17/02; G08C 2201/20; G08C 2201/40; G08C 2201/42; G08C 2201/63;
(Continued)

(56) References Cited

U.S. PATENT DOCUMENTS 10,593,174 B1 * 3/2020 Yoon ..... H04L 12/2816
10,841,382 B2 * 11/2020 Somaraju ..... H04W 4/70
(Continued)

FOREIGN PATENT DOCUMENTS

WO 2015195367 A1 12/2015

OTHER PUBLICATIONS

English Translation of International Search Report for International Application No. PCT/FR2020/051154; Date of Completion: Sep. 8, 2020; dated Sep. 23, 2020; 2 Pages.
(Continued)

*Primary Examiner* — Adnan Aziz
(74) *Attorney, Agent, or Firm* — CANTOR COLBURN LLP

(57) ABSTRACT

The invention relates to a method for configuring the communication between at least one actuator and a remote control, in order to enable a control of the at least one actuator by the remote control, the at least one actuator being configured to communicate with the remote control, the communication between the at least one actuator and the remote control being established according to a first protocol or according to a second protocol, the communication according to the second protocol being implemented via a connection to a router connected to the mains, the method being implemented by a mobile terminal, the mobile terminal being configured to communicate according to the first protocol with the at least one actuator, and with the remote control, the mobile terminal being configured to communicate with the router according to the first protocol or according to a third protocol, the method comprising the following steps: —identifying an identifier of the at least one actuator, —identifying an identifier of the remote control, —analysing in order to detect a presence or absence of the router, —if the absence of the router is detected by the mobile terminal during the analysis step, transmitting, to the remote control, the identifier of the at least one actuator and/or transmitting, to the actuator, the identifier of the remote control, then transmitting, to the remote control and to the actuator, a request to deactivate the first protocol, if the presence of the router is detected by the mobile terminal during the analysis step, transmitting, to the router, the
(Continued)

identifier of the at least one actuator and the identifier of the remote control.

8 Claims, 3 Drawing Sheets

(52) U.S. Cl.
CPC ..... *G08C 2201/40* (2013.01); *G08C 2201/42* (2013.01); *G08C 2201/63* (2013.01); *G08C 2201/93* (2013.01)

(58) Field of Classification Search
CPC ..... G08C 2201/93; A47H 5/00; H04W 12/50; H04W 4/80
See application file for complete search history.

(56) References Cited

U.S. PATENT DOCUMENTS

2016/0163190 A1 6/2016 Hirabayashi et al.
2017/0201881 A1* 7/2017 Davey ..... G06F 21/31
2017/0215261 A1* 7/2017 Potucek ..... H05B 47/105
2018/0070431 A1* 3/2018 Charlton ..... H05B 45/30
2019/0013960 A1* 1/2019 Sadwick ..... H05B 47/19
2019/0116480 A1* 4/2019 Schultz ..... H04W 52/0229
2020/0319621 A1* 10/2020 Roy ..... G01K 3/005

OTHER PUBLICATIONS

International Search Report for International Application No. PCT/FR2020/051154; Date of Completion: Sep. 8, 2020; dated Sep. 23, 2020; 4 Pages.
Written Opinion for International Application No. PCT/FR2020/051154; International Filing Date: Jul. 1, 2020; dated Sep. 23, 2020; 7 Pages.
English Translation of Written Opinion for International Application No. PCT/FR2020/051154; International Filing Date: Jul. 1, 2020; dated Sep. 23, 2020; 4 Pages.

* cited by examiner

METHOD FOR CONFIGURING THE COMMUNICATION BETWEEN AT LEAST ONE ACTUATOR AND A REMOTE CONTROL UNIT

CROSS REFERENCE TO RELATED APPLICATIONS

This application is a National Stage of PCT Application No. PCT/FR2020/051154 filed on Jul. 1, 2020, which claims priority to French Patent Application No. 19/07983 filed on Jul. 15, 2019, the contents each of which are incorporated herein by reference thereto.

TECHNICAL FIELD

The present invention concerns a device for the remote control of an actuator for building mobile equipment such as a rolling shutter, shade or curtain.

BACKGROUND

It is known to use a control device comprising an emitter using a radio frequency to emit a control signal, and a receiver of said frequency configured to receive said control signal, and to process the data of the received signal to control an actuator and/or set a parameter of an actuator according to the data of the signal.

In particular, such a known control device allows carrying out the remote, wireless control and/or the remote, wireless setting of operating parameters of an actuator of building mobile equipment, in particular to open or close a door, a gate, a window, a shade, a multimedia projection screen or a ventilation hatch.

Different types of wireless communication protocols exist allows carrying out such a remote control, for example, protocols known under trademarks, for example, ZIGBEE®, Bluetooth® or Bluetooth® Low Energy (BLE), 10 Homecontrol.

Certain known wireless remote control devices, for example based on the ZIGBEE® protocol, require the presence of a box, permanently powered, for example on the mains, which ensures a routing function. Thus, a standalone actuator, simply powered by battery, and its remote control unit cannot use a wireless communication device based on such a protocol, if there is not a router permanently powered, for example on the mains.

On the other hand, other wireless remote control devices are based on a protocol, such as BLE, for example, or the proprietary 10 Homecontrol protocol, compatible with a standalone power supply, for example by batteries, of remote control unit and of the actuators. BLE-based control devices have a lower performance and only have a limited autonomy, which should therefore be saved.

Proprietary protocols might be restricted in terms of compatibility.

Hence, the technical problem to be solved is to adapt to the constraints of the protocols and to the energy saving needs for standalone actuators.

Hence, the invention aims at providing a solution to all or part of these problems, by providing a wireless control which adapts depending on the presence or the absence of a router permanently powered on the mains.

BRIEF SUMMARY

To this end, the present invention concerns a method for configuring the communication between at least one actuator and a remote control unit, to enable a control of the at least one actuator from the remote control unit, the at least one actuator being configured to communicate with the remote control unit, the communication between the at least one actuator and the remote control unit being established according to a first protocol or according to a second protocol, the communication according to the second protocol being implemented via a connection to a router connected on the mains, the method being implemented by a mobile terminal, the mobile terminal being configured to communicate according to the first protocol with at least one actuator, and with the remote control unit, the mobile terminal being configured to communicate with the router according to the first protocol or according to a third protocol, the method comprising the following steps:

- identification of an identifier of the at least one actuator,
- identification of an identifier of the remote control unit,
- analysis to detect a presence or an absence of the router,
- if the absence of the router is detected by the mobile terminal during the analysis step, transmission to the remote control unit of the identifier of the at least one actuator and/or transmission to the actuator of the identifier of the remote control unit, then transmission to the remote control unit and to the actuator a request for activating the first protocol,
- if the presence of the router is detected by the mobile terminal during the analysis step, transmission to the router of the identifier of the at least one actuator and identifier of the remote control unit.

According to one implementation, the invention comprises one or more of the following features, alone or in a technically feasible combination.

According to one implementation, the at least one actuator is standalone.

According to one implementation, the method comprises, if the presence of the router is detected, a step of transmitting to the at least one actuator a request for activating the second protocol.

According to one implementation, the method comprises, if the presence of the router is detected, a step of transmitting to the remote control unit a request for activating the second protocol.

According to one implementation, the first protocol is a Bluetooth® or Bluetooth® Low Energy (BLE) type protocol.

According to one implementation, the second protocol is a ZIGBEE® type protocol.

According to these arrangements, when the presence of a router is detected, the second protocol is implemented by the at least one actuator and the remote control unit to communicate, allowing limiting the duration of the communication according to the first protocol, in particular when the communication according to the first protocol consumes more energy than the communication according to the second protocol, or when the communication according to the second protocol, for example of the ZIGBEE® type, is more efficient or secure than the communication according to the first protocol, for example of the Bluetooth® or Bluetooth® Low Energy (BLE) type. Thus, the wireless control dynamically adapts depending on the presence or absence of a router permanently powered on the mains.

According to one implementation, if the absence of a router is detected, the second protocol is automatically deactivated on the at least one actuator and/or on the remote control unit after a determined period, preferably in the range of a few seconds, or more preferably a few minutes, from the reception respectively by the actuator 1 and the remote control unit 2, of the request for activating the first protocol P1 transmitted by the mobile terminal 8.

According to these arrangements, the first protocol, of the Bluetooth® or Bluetooth® Low Energy (BLE) type, is implemented by default by the at least one actuator and the remote control unit to communicate.

According to one implementation, the step of transmitting to the remote control unit the request for activating the second protocol comprises a reset of the remote control unit.

According to one implementation, the mobile terminal comprises a sensor configured to carry out an optical reading of a code, for example a QR code, and the step of identifying the identifier of the at least one actuator comprises the optical reading of the code.

According to one implementation, the method comprises the creation and the recording on a user account of an association of the identifier of the at least one actuator and of the identifier of the remote control unit.

According to one implementation, the step of identifying an identifier of the at least one actuator, and the step of identifying an identifier of the remote control unit, comprise reading of the association recorded on the user account.

According to another aspect, the invention also concerns a method for configuring the communication between at least one actuator and a remote control unit, to enable a control of the at least one actuator from the remote control unit, the at least one actuator being configured to communicate with the remote control unit, the communication between the at least one actuator and the remote control unit being established according to a first protocol or according to a second protocol, the communication according to the second protocol being implemented via a connection to a router, the method comprising the following steps implemented by the at least one actuator:

- transmission to a mobile terminal of an identifier of the at least one actuator;
- activation on the at least one actuator of the first protocol and of the second protocol;
- when an absence of a router is detected during an analysis step implemented by a mobile terminal, reception of a request for activating the first protocol transmitted by said mobile terminal;
- upon completion of a predetermined period from the reception, deactivation of the second protocol;
- when a presence of a router is detected during an analysis step implemented by a mobile terminal, reception of a request for activating the second protocol emitted by the mobile terminal.

According to implementation, the method implemented by the actuator comprises, after the step of receiving a request for activating the second protocol emitted by the mobile terminal, a step of emitting according to the first protocol of the actuator to the remote control unit a request for activating the second protocol.

According to another aspect, the invention also concerns a method for configuring the communication between at least one actuator and a remote control unit, to enable a control of the at least one actuator from the remote control unit, the at least one actuator being configured to communicate with the remote control unit, the communication between the at least one actuator and the remote control unit being established according to a first protocol or according to a second protocol, the communication according to the second protocol being implemented via a connection to a router, the method comprising the following steps implemented by the remote control unit:

- transmission to a mobile terminal of an identifier of the remote control unit;
- activation on the remote control unit of the first protocol and of the second protocol;
- when an absence of a router is detected during an analysis step implemented by a mobile terminal, reception of a request for activating the first protocol transmitted by said mobile terminal;
- upon completion of a predetermined period from the reception, deactivation of the second protocol;
- when a presence of a router is detected, reception of a request for activating the second protocol emitted by the mobile terminal or by the actuator.

According to one implementation, the step of reception by the remote control unit of the request for activating the second protocol, comprises a reset of the remote control unit.

According to still another aspect, the invention also concerns a home automation apparatus or an actuator of a home automation apparatus comprising an electronic component, the electronic component comprising:

- a first communication module configured to implement a first protocol, and
- a second communication module configured to implement a second protocol, and
- a management module configured to implement the method according to any of the above-described implementations.

BRIEF DESCRIPTION OF THE DRAWINGS

For the proper understanding thereof, an embodiment and/or implementation of the invention is described with reference to the appended drawings representing, as a non-limiting example, an embodiment or implementation respectively of a device and/or of a method according to the invention. Similar references in the drawings refer to similar elements or elements whose functions are similar.

DETAILED DESCRIPTION

Figure 1:
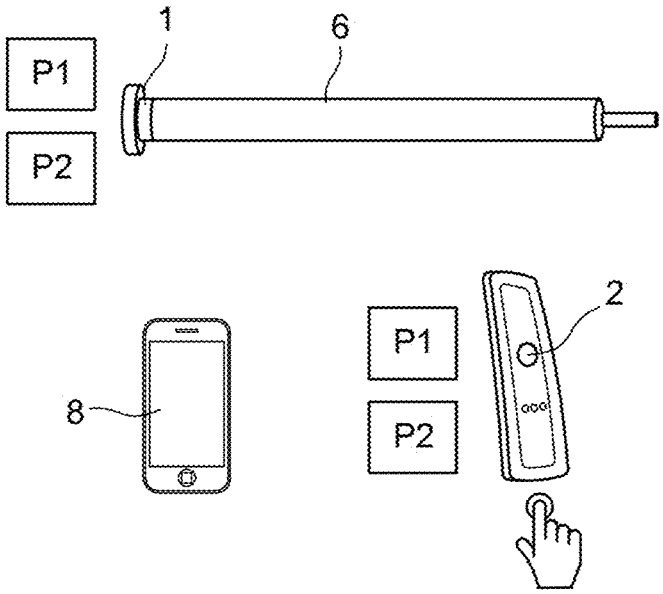
FIG. 1 is a simplified representation of an actuator of a rolling shade, of a remote control unit, and of a mobile terminal, each capable of implementing the method according to an aspect of the invention.
Figure 2:
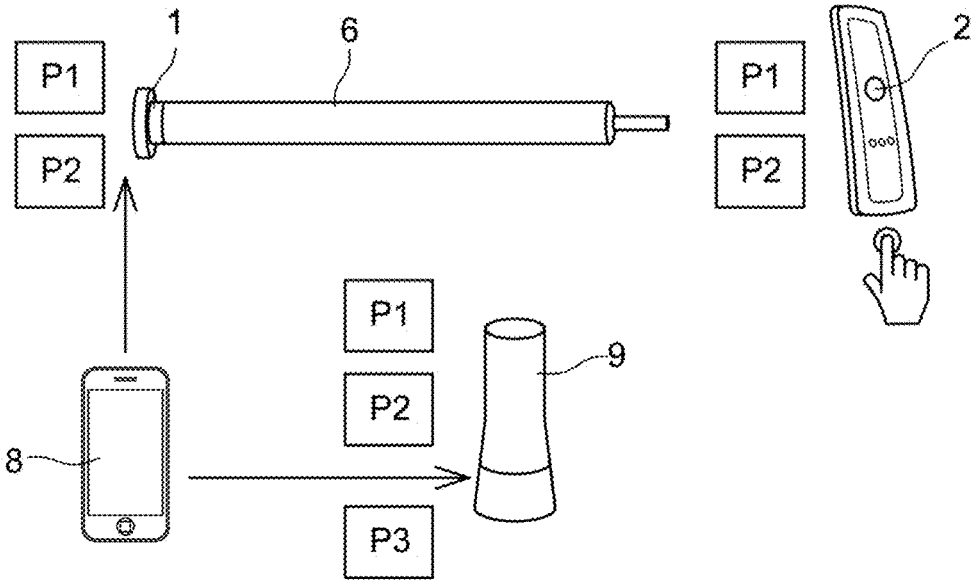
FIG. 2 is a simplified representation of an actuator of a rolling shade, of a remote control unit, of a mobile terminal, and of a router, each capable of implementing the method according to an aspect of the invention.

There are many buildings equipped with controllable electrical equipment intended to provide comfort and energy management functions, such as heating, ventilation and air-conditioning, but also lighting management and shutter control, such as shades or rolling shutters placed in front the windows of the building or still remote security by controlling closure systems (doors, latches). Automation controls are the sets of rules that govern the control of the electrical equipment by a programmable supervision system, in order to ensure better comfort for the occupants of the building or to optimize energy consumption. The building may consists of a set of offices, or a building for residential use, or a building for commercial or industrial use, or any combination of these uses. It may in particular consist of a building or an individual house. In the residential sector, automation controls are most often referred to by the term "home automation". To simplify, hereinafter, the term home automation will be used to refer to both residential and tertiary applications. An example of controllable home automation equipment or apparatus 6 is represented in FIGS. 1 and 2.

One or several embodiment(s) of the method according to the invention will be described with reference to and in the context of an application to a home automation installation. But those skilled in the art should understand that this is not limiting.

A home automation installation may comprise a first category of home automation apparatuses or devices, which we will call a controllable home automation apparatus. An example of a controllable home automation apparatus 6 is illustrated on FIGS. 1 and 2. Preferably, each controllable home automation apparatus 6 of a home automation installation includes an actuator 1 controllable by means of at least one control signal. The different controllable home automation apparatuses 6 of a home automation system may have differences from each other and perform different functions within the home automation system. For example, the actuator of the apparatus 6 of FIGS. 1 and 2 may be an electromechanical actuator for displacing or winding a shade or a blackout shutter, such as a panel, a shade or an opaque curtain, associated with at least one opening of the building, such as a window or a bay window. The actuator 1 of the controllable home automation apparatus 6 comprises an electric motor, arranged so as to move the shade by winding it or by winding cords around an axis driven in rotation by the motor. The displacement of this blackout shutter allows regulating the amount of sunlight received by the building throughout this opening. According to another example, the apparatus may be a compressor adapted for implementing an expansion-compression cycle of a heat-transfer fluid within a building refrigeration system, such as an air-conditioner or a heat pump, in order to regulate the temperature inside the building. According to still another example, the controllable home automation apparatus may also consist of lighting, for example interior or exterior lighting or a lighting control system, an alarm system, or even a video camera, in particular a video-surveillance camera.

Each controllable home automation apparatus 6 receives control signals emitted by a second category of home automation apparatuses, that of remote control units 2; the remote control unit 2 is configured to transmit control instructions to the actuator 1 of the controllable home automation apparatus 6. The remote control unit may be a nomadic or wall-mounted remote control unit, equipped with a wireless emitter. The remote control unit comprises a human-machine interface, with which a user can interact. The remote control unit can also comprise sensors, such as for example an internal clock, which enables it to emit programmed commands at predefined times, for the attention of a controllable home automation apparatus.

A home automation installation may include one or several sensor(s), not represented in the figures. A sensor, by definition, is intended to convert one or several physical quantit(y/ies) relating to the state of the building or its environment into one or several signal(s) proportional to this physical quantity. For example, this signal is an electrical signal, a light signal or a radiofrequency signal. This signal may be transmitted by the sensor to at least one home automation piece of equipment, whether controllable 6 or not, such as for example a remote control unit 2.

Sensors are home automation apparatuses that we will classify, by convention, in a third category, called automation control units. Nevertheless, the sensors may be integrated into a controllable home automation apparatus 6, or into a remote control unit 2, or still be independent of these elements.

For example, the physical quantities measured by the sensors are, without limitation, a temperature, for example a temperature of a wall or of the ambient air, a humidity level, a luminosity value, or a pressure of the ambient air, a consumption value for example of water, gas or electricity, the opening state of a rolling shutter, the position of a door leaf such as a window, whether motorized or not, or still the presence or the absence of a user.

A home automation installation may also comprise a fourth category of home automation apparatuses, called routers, intended for the management of the communications of home automation apparatuses 2, 6 of the home automation installation, with each other and/or with any possible devices external to the installation, via a wide communications network, for example the Internet. A router 9, when it is present as illustrated in FIG. 2, is thus configured in particular to transmit control instructions emitted by a remote control unit 6 to the actuator 1 of the associated controllable home automation apparatus 6. Alternatively or complementarily, the router 9 is configured to transmit control instructions from a server external to the building in which the installation is physically located, to the actuator 1 of the controllable home automation apparatus 6 of the installation.

Each home automation apparatus 2, 6, 9 of a home automation installation, in particular each controllable home automation apparatus 6, is powered with electrical energy. The supply of electrical energy to a home automation apparatus 2, 6, 9 may be achieved by an independent source associated with the home automation apparatus 2, 6, 9; in this case the home automation apparatus 2, 6, 9 will be called standalone. Said standalone electrical power source may for example consist of one or several batter(y/ies), said batteries may be rechargeable or not; said standalone electrical power source may also consist, for example, of a set of rechargeable batteries and a photovoltaic solar panel, intended to recharge the batteries. When the home automation apparatus 6 is not standalone, its electrical energy supply is achieved via a connection of the home automation apparatus 6 on the mains or to a continuous electrical power supply bus. In practice, router 9 is never standalone, and is therefore always connected on the mains, the communication needs with other apparatuses in the installation and outside the installation, for example a server, being frequent and requiring an external electrical power supply.

The communication between the remote control unit 2 and an actuator 1 is performed according to one or several determined communication protocol(s) P1, P2, P3.

The communication, according to each of the one or several protocol(s) P1, P2, P3 is performed by exchange of messages, for example in the form of packets, each of these messages containing at least one header, which includes an origin and/or a destination of the message, and useful data, such as a command.

According to one embodiment, a first protocol P1 is a protocol of the Bluetooth® Low Energy (BLE) type, a second protocol P2 is a protocol of the ZIGBEE® type, and a third protocol P3 is another protocol, for example of the WIFI or IP type.

According to one embodiment, the home automation apparatuses of the first category, i.e. controllable 6, or of the second category, i.e. of the remote control unit type 2, or of the third category, i.e. of the sensor type, or of the fourth category, i.e. of the router 9 type, are configured to implement the first protocol P1 and/or the second protocol P2. According to one embodiment, the apparatuses of the fourth category are also configured to implement the third protocol P3.

An identifier allows identifying the different characteristics of the actuator 1 of a home automation apparatus 6 or the different characteristics of a remote control unit 2 of a home automation system; this identifier may for example contain in particular the following information on the actuator 1:

A unique identification code of the apparatus,

An identifier of each of the protocols P1, P2, P3 available to communicate with the actuator 1 or the remote control unit 2;

An installation code for each of the protocols P1, P2, P3;

A type of home automation apparatus or device, for example remote control unit, actuator, stand-alone actuator, sensor, router, etc.

For example, the identifier may be of the QR code type, affixed on a case of the apparatus, which is then accessible via a mobile terminal 8 equipped with a software application configured to scan said identifier via a camera, said camera being integrated by example to said mobile terminal 8.

Thus, thanks to the mobile terminal 8, it is possible to determine the different characteristics of the different home automation apparatuses 2, 6, 9, present in the home automation installation, in particular the different communication protocols that could be implemented respectively by each of these apparatuses, as well as the characteristics of the apparatuses 2, 6, 9 in terms of power supply, standalone or connected on the mains. It is also possible to save, in particular on a user account, the identifiers of the different home automation apparatuses of an installation as well as the association links between them. This information may be stored at the level of the mobile terminal or at the level of a remote server with which the mobile terminal can be in communication, for example by using the third protocol P3.

According to one embodiment, for the implementation of the first and of the second protocol P1, P2, the home automation apparatuses of the first or second or third categories, i.e. actuators 1, sensors 6, remote control units 2, are equipped with a programmed electronic component; this component integrates the transport software layers, and the application software layers, sometimes "Cluster Library", of these two protocols; according to a preferred architecture of said electronic component, one single unified application software layer, or intermediate module, is configured to implement the two protocols, with a separate transport layer for each of the two protocols. Alternatively, this unified software layer concerns only part of the application software layers of the two protocols. This preferred architecture allows using the application software layers related to the first protocol as a gateway, sometimes called a proxy, to introduce the mobile terminal 8 into a network of devices communicating according to the second protocol P2.

According to one embodiment, the mobile terminal 8 is an intelligent telephone, often called a "smartphone".

Advantageously, it is possible to provide for adding to the unified application layer, on the electronic component, an additional management module, said management module also being called a "BLE commissioning" module according to the usual terminology; said management module interfaces with the intermediate module to manage the communication with the standalone actuators. This management module allows adding functionalities not provided for in the unified software application layer, while using the operating principles of the intermediate module, or proxy, so as to manage the exchanges between the home automation apparatuses 2, 6 using the first protocol P1, and the home automation apparatuses 2, 6 using the second protocol P2, at least some of the home automation apparatuses being standalone.

Figure 5:
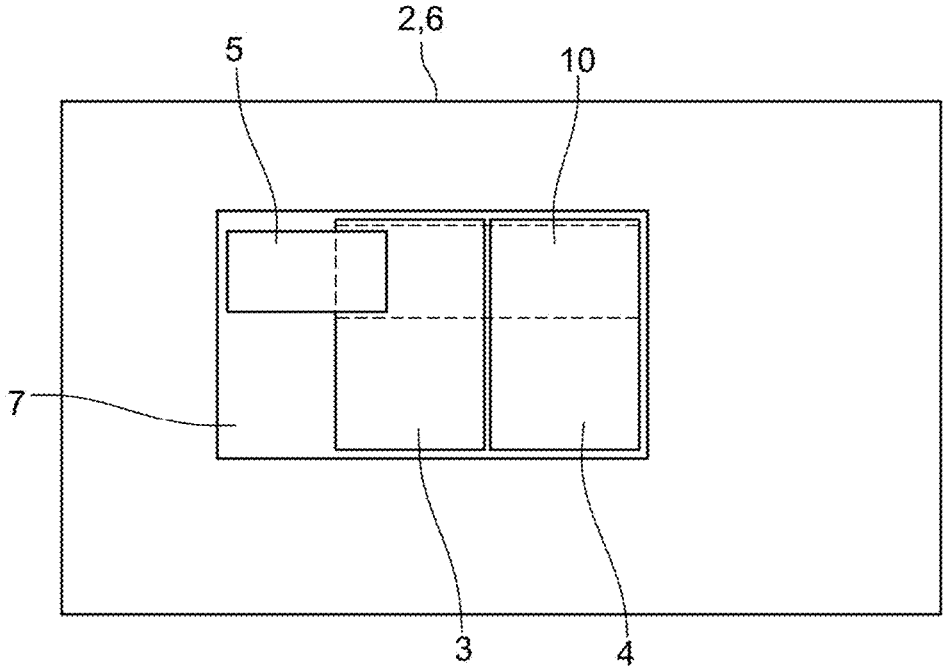
FIG. 5 is a schematic representation of a preferred embodiment of the integrated electronic component of the home automation apparatuses.

Thus, according to a preferred embodiment schematically illustrated in FIG. 5, the integrated electronic component 7 comprises a first communication module 3, corresponding to the transport software layer and to the application software layer configured for the management of the communications according to the first protocol P1, and a second communication module 4, corresponding to the transport software layer and to the application software layer configured for the management of the communications according to the second protocol P2, an intermediate module 10 duplicating at least part of the software application layers of the two protocols P1 and P2 and a management module 5, so-called "BLE commissioning" module, configured to interface with the intermediate module and to manage the exchanges of messages between home automation apparatuses 2, 6 according to the two protocols P1, P2, on the one hand, and on the other hand to manage the exchanges of messages between the mobile terminal 8 and these home automation apparatuses 2, 6.

Figure 3:
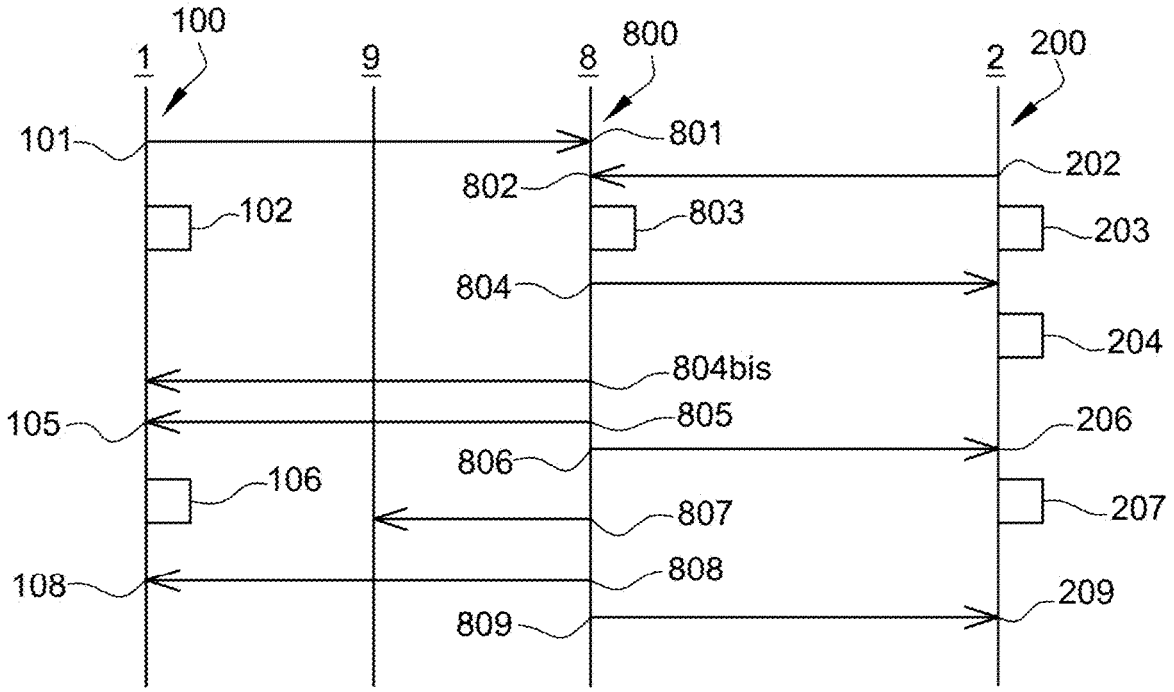
FIG. 3 is a schematic representation of the different steps of the method according to the invention, according to an embodiment implemented respectively by an actuator, a rolling shade, a remote control unit, a mobile terminal, and a router.

Thus, with reference to FIG. 3, during a first and a second step 801, 802 of the method 800 for configuring the communication between an actuator 1 of an apparatus 6 and a remote control unit 2, said method 800 being implemented by the mobile terminal 8, an identifier of at least one actuator 1 is identified 801, and an identifier of a remote control unit 2 is identified 802, for example via the QR codes scanned with the mobile terminal 8.

For example, through a manual action on a human-machine interface of the mobile terminal 8, the configuration method 800 can then switch into the next step 803 of analyzing the identifiers.

This step comprises an analysis 803 of the characteristic information associated with the identifiers identified in the previous steps. This analysis then allows detecting 803 the absence or the presence of a device powered on the mains.

In practice, when the QR code of the remote control unit 2 and of the actuator 1 (or of the home automation apparatus 6 that includes said actuator 1) are scanned with the mobile terminal 8, these devices are recognized as standalone elements because their type reference, written in the QR code, indicates them as such.

During the analysis step 803, it is advantageously possible to distinguish not only the absence or the presence of a device powered on the mains, but also in the case where a device powered on the mains is present, whether the device is a router 9, or an actuator 1 or another device powered on the mains and which is not a router 9.

When no device powered on the mains is detected during the detection step 803, the mobile terminal 8 proceeds with a step of transmission 804, to the remote control unit 2, of the identifier of the at least one actuator 1, and/or in a step of transmission 804bis, to the actuator 1, of the identifier of the remote control unit 2, followed by a step of transmission 805 to the actuator 1 of a request for activating the first protocol P1 on the actuator 1, and of transmission 806 to the remote control unit 2 of a request for activating the first protocol P1 on the remote control unit 2.

Complementarily according to another embodiment, when no router 9 is detected during the analysis step 803, it is chosen not to use the second protocol P2 for the communication between the remote control unit 2 and the actuator 1, even though there is another device in the installation, for example an actuator, connected on the mains.

Indeed, apart from the case of a router 9, connected on the mains and placed centrally in the installation to reach all of the devices of the installation within radio range, it is difficult to guarantee that another device, for example an actuator that would be connected on the mains, is within radio range of all of the standalone devices of the installation. Yet, according to the second protocol P2, the device on the mains is defined as a "letterbox" element, i.e. configured for the reception of the messages intended for a standalone actuator 1 on standby and the restitution of the message during the phases of activity of said standalone actuator; it is therefore mandatory that it is within radio range.

According to one embodiment, the electronic component, configured to implement the first protocol P1 and the second protocol P2, activates by default and together the first protocol P1 and the second protocol P2, during the initialization of the actuator 1 and of the remote control unit 2, and automatically deactivates the second protocol P2 upon completion of a predetermined period in the range of a few seconds, or possibly a few minutes, when no device powered on the mains or no router 9 is detected during the analysis step 803, i.e. after the actuator 1 and the remote control unit 2 have received the request for activating the first of the first protocol P1 transmitted 805, 806 by the mobile terminal 8, respectively to the actuator 1, and to the remote control unit 2.

Hence, the second protocol P2 can be kept only in the case of the detection during the analysis step 803 of the presence of a device powered on the mains or only of a router 9.

According to one embodiment, in the case of detecting the presence of a router 9, a step 808 of transmission by the mobile terminal 8 to the at least one actuator 1, and a step 809 of transmission by the mobile terminal 8 to the remote control unit 2, of a request for activating the second protocol P2, are respectively implemented. This activation request corresponds to maintaining the activation of the protocol P2 at the level of the actuator 1 and of the remote control unit 2, if the latter is temporarily activated.

According to another mode of implementation, in the case of detecting the presence of a router 9, only the step of transmission 808 to an actuator 1 of a request for activating the second protocol P2, is implemented by the mobile terminal 8; it is the actuator 1 that then transmits a request for activating the second protocol P2 intended for the remote control unit 2; the transmission of said request, by the actuator 1 to the remote control unit 2, is then carried out according to the first protocol P1, which is implemented on the actuator 1 simultaneously with the second protocol P2, for a determined period of time, called latency time, until the protocol P2 is activated on the remote control unit 2. This step then uses the proxy functionality of the intermediate module and the functionalities of the management module, to manage the transmission of a request for activating the second protocol P2 to the remote control unit 2 using the first protocol P1.

Hence, there may be a latency time between the switch of the actuator 1 from P1 to P2 and the same switch at the level of the remote control unit 2. During this latency time, the actuator 1 of the apparatus 6 implements the two protocols P1 and P2.

When the remote control unit(s) 2 associated with the actuator 1 of the apparatus 6 have all received a request for activating the second protocol, and following a possible check-up that the second protocol is actually usable by the remote control unit 2, the first protocol could be deactivated at the level of the actuator 1 as well as at the level of the remote control unit 2. This deactivation is again managed by the management module.

Alternatively, the first protocol may be kept active in a use mode, off the latency time. It may then possibly be provided for adjusting the signaling frequencies, sometimes called "advertising" frequencies, of the first protocol P1, and/or the scanning frequency of the second protocol P2, to keep an advertising frequency, for example in the range of 1 to 10 s between "advertising" frames. This offers a means of "recovering" the communication between the devices of the installation in the event of failure of the exchanges according to the second protocol P2.

Figure 4:
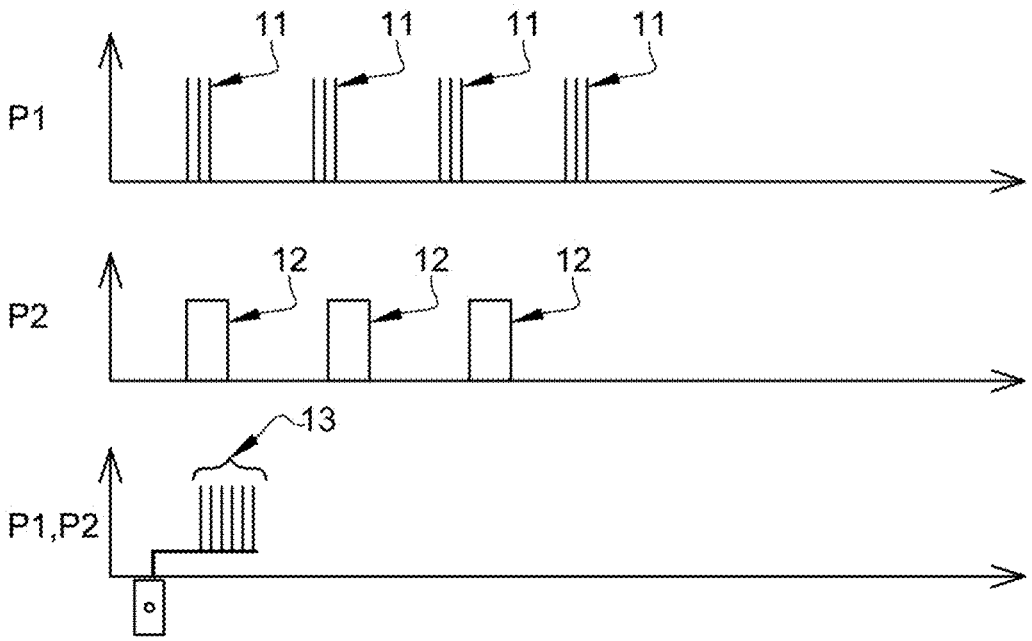
FIG. 4 is a schematic representation of the principle of the signaling frequencies according to a first protocol, of the scanning frequencies according to a second protocol, and a schematic representation of a wake-up of a remote control unit and the emission of a control message according to the first or second protocol.

FIG. 4 shows the principle:

- of the signaling frequencies according to the first protocol P1, wherein a presence signal 11 is emitted every 330 ms for example, as may be the case for the BLE® protocol;
- of the scanning frequencies 12 according to the second protocol P2 wherein a wake-up message is emitted periodically before a request for a possible message stored on hold, as may be the case for the ZIGBEE® protocol;
- of a wake-up followed by the emission of a control signal 13, according to the first or the second protocol P1 or P2, wherein the wake-up of the remote control unit is for example related to a press on a button of the human-machine interface and precedes the transmission of a control frame.

Thus, it is possible to provide for a temporary double use of the first and second protocols, temporarily or in use, with an adapted frequency of emissions in the two protocols.

According to one aspect, illustrated in FIG. 3, the invention also relates to a method 100 for configuring the communication between at least one actuator 1 and a remote control unit 2, to enable a control of the at least one actuator 1 from the remote control unit 2, the at least one actuator 1 being configured to communicate with the remote control unit 2, the communication between the at least one actuator 1 and the remote control unit 2 being established according to a first protocol P1 or according to a second protocol P2, the communication according to the second protocol P2 being implemented via a connection to a router 9, the method comprising the following steps implemented by the at least one actuator 1:

- transmission 101 to a mobile terminal 8 of an identifier of the at least one actuator 1;
- activation 102 on the at least one actuator 1 of the first protocol P1 and of the second protocol P2;
- when an absence of a router 9 is detected during an analysis step 803 implemented by a mobile terminal 8, reception 105 of a request for activating the first protocol P1 transmitted 805 by said mobile terminal 8;

upon completion of a predetermined period from the reception 105, deactivation 106 of the second protocol P1;

when a presence of a router 9 is detected during an analysis step 803 implemented by a mobile terminal 8, reception 108 of a request for activating the second protocol P2 emitted by the mobile terminal 8.

According to one embodiment, the method 100 implemented by the actuator comprises, after the step of receiving a request for activating the second protocol P2 emitted by the mobile terminal 8, a step of emitting according to the first protocol P1 from the actuator 1 to the remote control unit 2 a request for activating the second protocol P2.

According to another aspect, illustrated in FIG. 3, the invention also relates to a method 200 for configuring the communication between at least one actuator 1 and a remote control unit 2, to enable a control of the at least one actuator 1 from the remote control unit 2, the at least one actuator 1 being configured to communicate with the remote control unit 2, the communication between the at least one actuator 1 and the remote control unit 2 being established according to a first protocol P1 or according to a second protocol P2, the communication according to the second protocol P2 being implemented via a connection to a router 9, the method comprising the steps implemented by the remote control unit 2:

transmission 202 to a mobile terminal 8 of an identifier of the remote control unit 2;

activation 203 on the remote control unit 2 of the first protocol P1 and the second protocol P2;

when an absence of a router 9 is detected during an analysis step 803 implemented by a mobile terminal 8, reception 206 of a request for activating the first protocol P1 transmitted 806 by said mobile terminal 8;

upon completion of a predetermined period from reception 206, deactivation 207 of the second protocol P1;

when a presence of a router 9 is detected, reception 209 of a request for activating the second protocol P2 emitted 809 by the mobile terminal 8 or by the actuator 1.

According to one implementation, the step of receiving by the remote control unit the request for activating the second protocol comprises a reset of the remote control unit.

The invention claimed is:

1. A method for configuring communication between at least one actuator and a remote control unit, to enable a control of the at least one actuator from the remote control unit, the at least one actuator being configured to communicate with the remote control unit, the communication between the at least one actuator and the remote control unit being established according to a first protocol or according to a second protocol, the communication according to the second protocol being implemented via a connection to a router connected on the mains, the method being implemented by a mobile terminal, the mobile terminal being configured to communicate according to the first protocol with at least one actuator, and with the remote control unit, the mobile terminal being configured to communicate with the router according to the first protocol or according to a third protocol, the method comprising the following steps:

identification of an identifier of the at least one actuator, identification of an identifier of the remote control unit, analysis to detect a presence or an absence of the router, if the absence of the router is detected by the mobile terminal during the analysis step, transmission to the remote control unit of the identifier of the at least one actuator and/or transmission to the actuator of the identifier of the remote control unit, then transmission to the remote control unit and to the actuator a request for activating the first protocol, if the presence of the router is detected by the mobile terminal during the analysis step transmission to the router of the identifier of the at least one actuator and identifier of the remote control unit.

2. The method according to claim 1, wherein the at least one actuator is standalone.

3. The method according to claim 1, comprising, if the presence of the router is detected, a step of transmitting to the at least one actuator a request for activating the second protocol.

4. The method according to claim 1, comprising, if the presence of the router is detected, a step of transmitting to the remote control unit a request for activating the second protocol.

5. The method according to claim 2, comprising, if the presence of the router is detected, a step of transmitting to the remote control unit a request for activating the second protocol.

6. A method for configuring communication between at least one actuator and a remote control unit, to enable a control of the at least one actuator from the remote control unit, the at least one actuator being configured to communicate with the remote control unit, the communication between the at least one actuator and the remote control unit being established according to a first protocol or according to a second protocol, the communication according to the second protocol being implemented via a connection to a router, the method comprising the following steps implemented by the at least one actuator:

transmission to a mobile terminal of an identifier of the at least one actuator;

activation on the at least one actuator of the first protocol and of the second protocol;

when an absence of a router is detected during an analysis step implemented by a mobile terminal, reception of a request for activating the first protocol transmitted by said mobile terminal, after a transmission, by the mobile terminal, to the remote control unit of the identifier of the at least one actuator and/or transmission, by the mobile terminal, to the actuator of the identifier of the remote control unit;

upon completion of a predetermined period from the reception, deactivation of the second protocol;

when a presence of a router is detected during an analysis step implemented by a mobile terminal, reception of a request for activating the second protocol emitted by the mobile terminal.

7. A method for configuring communication between at least one actuator and a remote control unit, to enable a control of the at least one actuator from the remote control unit, the at least one actuator being configured to communicate with the remote control unit, the communication between the at least one actuator and the remote control unit being established according to a first protocol or according to a second protocol, the communication according to the second protocol being implemented via a connection to a router, the method comprising the following steps implemented by the remote control unit:

transmission to a mobile terminal of an identifier of the remote control unit;

activation on the remote control unit of the first protocol and of the second protocol;

when an absence of a router is detected during an analysis step implemented by a mobile terminal, reception of a request for activating the first protocol transmitted by said mobile terminal, after a transmission, by the mobile terminal, to the remote control unit of the identifier of the at least one actuator and/or transmission, by the mobile terminal, to the actuator of the identifier of the remote control unit;

upon completion of a predetermined period from the reception, deactivation of the second protocol;

when a presence of a router is detected, reception of a request for activating the second protocol emitted by the mobile terminal or by the actuator.

8. A home automation apparatus or an actuator of a home automation apparatus comprising an electronic component, the electronic component comprising:

a first communication module configured to implement a first protocol, and a second communication module configured to implement a second protocol, and a management module configured to implement the method according to claim 3.

* * * * *